US005878389A

United States Patent [19]

Hermansky et al.

[11] Patent Number: 5,878,389

[45] Date of Patent: Mar. 2, 1999

[54] METHOD AND SYSTEM FOR GENERATING AN ESTIMATED CLEAN SPEECH SIGNAL FROM A NOISY SPEECH SIGNAL

[75] Inventors: Hynek Hermansky, Banks; Eric A. Wan; Carlos M. Avendano, both of Hillsboro, all of Oreg.

[73] Assignee: Oregon Graduate Institute of Science & Technology, Beaverton, Oreg.

[21] Appl. No.: 496,068

[22] Filed: Jun. 28, 1995

[51] Int. Cl.[6] ..... G10L 3/02

[52] U.S. Cl. ..... 704/226; 704/203

[58] Field of Search ..... 396/2.09, 2.1, 396/2.11, 2.12, 2.35, 2.36

[56] References Cited

U.S. PATENT DOCUMENTS

| | | | |
|---|---|---|---|
| 4,052,559 | 10/1977 | Paul et al. | 179/1 P |
| 4,701,953 | 10/1987 | White | 395/2.1 |
| 4,737,976 | 4/1988 | Borth et al. | 379/58 |
| 4,747,143 | 5/1988 | Kroeger et al. | 395/2.34 |
| 4,897,878 | 1/1990 | Boll et al. | 395/2.4 |
| 4,937,873 | 6/1990 | McAulay et al. | 381/51 |
| 5,012,519 | 4/1991 | Adlersberg et al. | 395/2.34 |
| 5,054,072 | 10/1991 | McAulay et al. | 395/2.1 |
| 5,185,848 | 2/1993 | Aritsuka et al. | 395/2.11 |
| 5,214,708 | 5/1993 | McEachern | 395/2.1 |
| 5,353,374 | 10/1994 | Wilson et al. | 395/2.35 |
| 5,394,473 | 2/1995 | Davidson | 395/2.67 |
| 5,450,522 | 9/1995 | Hermansky et al. | 395/2.2 |
| 5,461,697 | 10/1995 | Nishimura et al. | 395/2.41 |
| 5,537,647 | 7/1996 | Hermansky et al. | 395/2.2 |
| 5,586,215 | 12/1996 | Stork et al. | 395/2.41 |
| 5,661,822 | 8/1997 | Knowles et al. | 382/233 |

OTHER PUBLICATIONS

"Suppression of Acoustic Noise in speech Using Spectral Subtraction", vol. ASSp–27, No. 2, Apr. 1979.

"Noise Suppression in cellular communications", Interactive Voice Technology for Telecommunications Applications Sep. 1994.

"Speech enhancement based on temporal processing", ICASSP 1995, May 9–12, hermansky et al May 1995.

"Integrating RASTA–PLP into speech recognition", ICASSP 1994, Koehler et al. 1994.

IEEE Transactions on Accoustics, Speech and Signal Processing, vol. ASSP–25, No. 3, Jun. 1977 Short Term Spectral Analysis, Synthesis, and Modification by Discrete Fourier Transform, Jont B. Allen.

IEEE Transactions on Accoustics, Speech and Signal Processing, vol. ASSP–32, No. 2, Apr. 1984 Signal Estimation from Modified Short–Time Fourier Transform.

IEEE Transactions on Accoustics, Speech and Signal Processing, vol. ASSP–27, No. 2, Apr. 1979 Suppression of Accoustic Noise in Speech Using Spectral Subtraction.

*Neural Works –A Comprehensive Foundation*, Simon Haykin, 1994.

*Random Signals: Detection, Estimation and Data Analysis*, K. Sam Shanmugan, 1988.

*Modern Signals and Systems*, H. Kwakernaak, R. Sivan, R. Strijbos, 1991, pp. 314 and 531.

*Primary Examiner*—David R. Hudspeth
*Assistant Examiner*—Michael N. Opsasnick
*Attorney, Agent, or Firm*—Brooks & Kushman

[57] ABSTRACT

A method and system for generating an estimate of a clean speech signal extracts time trajections of short-term parameters from a noisy speech signal to obtain a plurality of frequency components each having a magnitude spectrum and a phase spectrum. The magnitude spectrum is then compressed, filtered and then decompressed to obtain a modified magnitude spectrum. The speech signal is then reconstructed using the original phase spectrum and the modified magnitude spectrum.

26 Claims, 2 Drawing Sheets

METHOD AND SYSTEM FOR GENERATING AN ESTIMATED CLEAN SPEECH SIGNAL FROM A NOISY SPEECH SIGNAL

TECHNICAL FIELD

This invention relates to speech enhancement and, in particular, to a method and system for speech enhancement utilizing temporal processing.

BACKGROUND ART

Voice communication systems are susceptible to interfering signals normally referred to as noise. The interfering signals may have harmful effects on the performance of any speech communication system. These effects depend on the specific system being used, on the nature of the noise, the way it interacts with the clean speech signal, and on the relative intensity of the noise compared to that of the signal.

A speech communication system may simply be a recording which was performed in a noisy environment, a standard digital or analog communication system, or a speech recognition system for human/machine communication. Noise may be present at the input of the communication system, in the channel, or at the receiving end. The noise may be correlated or uncorrelated with the signal. It may accompany the clean signal in an additive, multiplicative, or any other more general manner. Examples of noise sources include competitive speech, a background sound like music, a fan, machines, a door slamming, wind or traffic, room reverberation, and Gaussian channel noise.

The ultimate goal of speech enhancement is to minimize the effect of the noise on the performance of speech communication systems. Consider, for example, a cellular radio/telephone communication system. In this system, the transmitted signal is composed of the original speech and the background noise in the car. The background noise is generated by an engine, a fan, traffic, wind, etc. The transmitted signal is also affected by the radio channel noise. As a result, noisy speech with low quality and reduced intelligibility may be delivered by such systems.

Background noise may have additional devastating effects in the performance of a system. Specifically, if the system encodes the signal prior to its transmission, then the performance of the speech coder may significantly deteriorate in the presence of the noise. The reason is that speech coders rely on some statistical model for the clean signal. This model becomes invalid when the signal is noisy. For a similar reason, if a cellular radio system is equipped with a speech recognizer for automatic dialing, then the error rate of such recognizer will be elevated in the presence of the background noise. The goals of speech enhancement in this example are to improve perceptual aspects of the transmitted noise and speech signals as well as to reduce the speech recognizer error rate.

The problem of speech enhancement has been a challenge for many years. Different solutions with various degrees of success have been proposed over the years. One known prior art speech enhancement solution is the spectral subtraction approach as described in "Suppression of Acoustic Noise in Speech Using Spectral Subtraction," by S.F. Boll, IEEE Transactions on Acoustics, Speech, and Signal Processing, Vol. ASSP-27, No. 2, April 1979. This approach provides estimates of the clean signal based on the short-term spectrum of the noisy signal. Estimation is performed on a frame-by-frame basis, where each frame consists of 20–40 ms of speech samples. In a spectral subtraction approach, the signal is Fourier transformed, and spectral components whose values are smaller than that of the noise are nulled. The surviving spectral components are modified by an appropriately chosen gain function. The signal estimate is obtained from inverse Fourier transforms of the modified spectral components. Major drawbacks of the spectral subtraction enhancement approach, however, are that noise needs to be explicitly estimated, and the residual noise has annoying tonal characteristics referred to as "musical noise".

The known prior art fails to disclose a simple and accurate method for enhancing the quality of speech transmitted from a noisy environment.

DISCLOSURE OF THE INVENTION

It is thus a general object of the present invention to provide a method and system for enhancing speech utilizing temporal processing.

In carrying out the above objects and other objects, features and advantages, of the present invention, a method is provided for enhancing noisy speech. The method includes the step of extracting time trajectories of short-term parameters from a noisy speech signal to obtain a plurality of frequency components each having a first magnitude and a phase. The method continues with the step of performing a non-linear operation on the first magnitude of the plurality of frequency components to obtain a second magnitude. Next, the method continues with the step of filtering the time trajectories of the second magnitude of the plurality of frequency components so as to map the noisy speech to an estimate of the plurality of magnitudes of the frequency components of a clean speech signal. The method continues with the step of performing an inverse non-linear operation on the filtered second magnitude of the plurality of frequency components to obtain a third magnitude. Finally, the method concludes with the step of estimating the clean speech signal based on the third magnitude of the plurality of frequency components and the phase of the plurality of frequency components to generate the clean speech signal.

In further carrying out the above objects and other objects, features and advantages, of the present invention, a system is also provided for carrying out the steps of the above described method. The system includes a first processor for extracting time trajectories of short-term parameters from the noisy speech signal to obtain the plurality of frequency components each having a first magnitude spectrum and a phase spectrum. The first processor also performs a non-linear operation on the first magnitude spectrum to obtain a second magnitude spectrum. The system also includes a filter for filtering the time trajectories of the second magnitude spectrum. The system further includes a second processor for performing an inverse non-linear operation on the filtered second magnitude spectrum to obtain a third magnitude spectrum. The second processor also combines the third magnitude with the phase spectrum to generate an estimated clean speech signal.

The above objects, features and advantages of the present invention, as well as others, are readily apparent from the following detailed description of the best mode for carrying out the invention when taken in connection with the accompanying drawings.

BEST MODES FOR CARRYING OUT THE INVENTION

Figure 1:
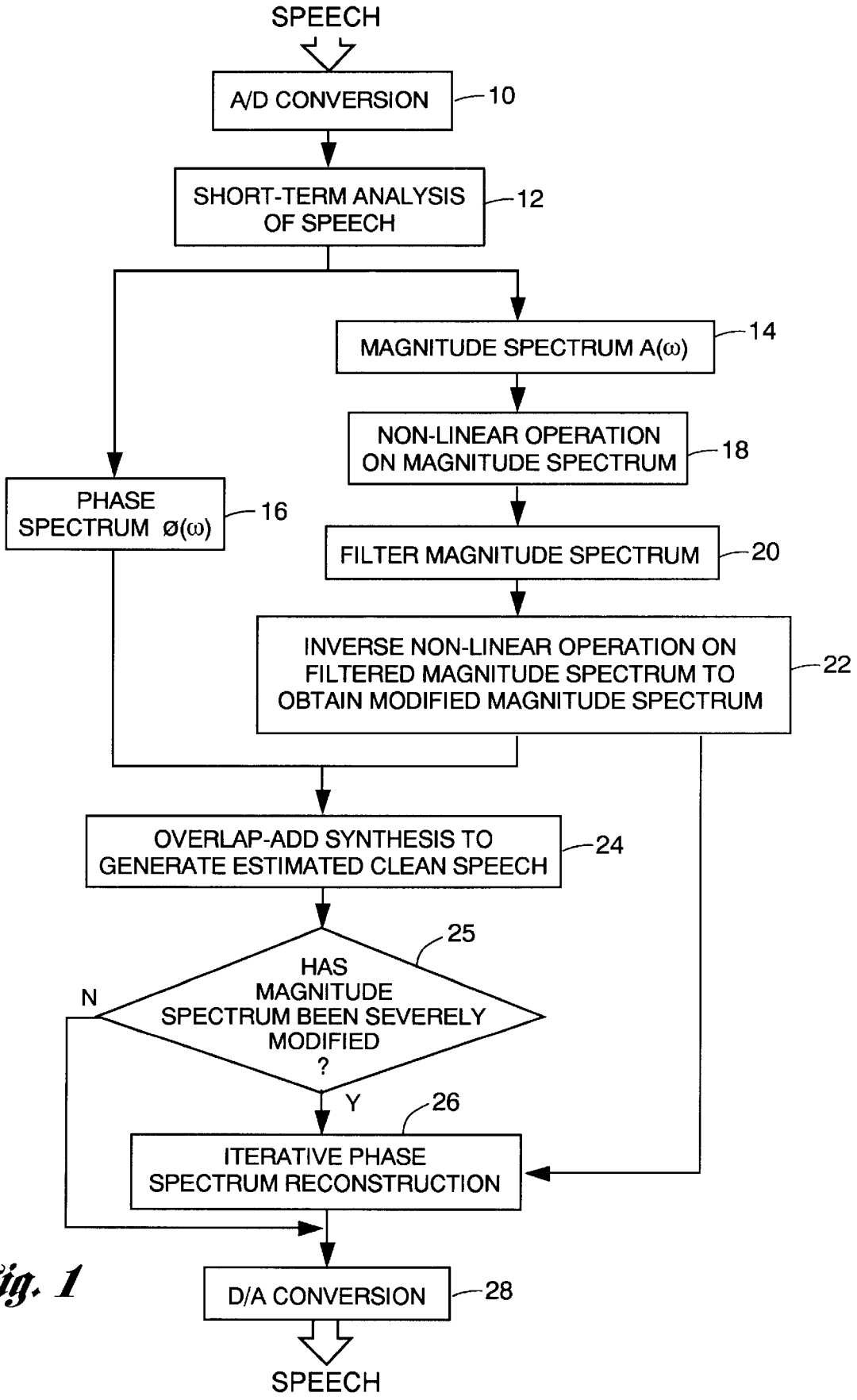
FIG. 1 is a flow diagram illustrating the general sequence of steps associated with the operation of the present invention.

Referring to FIG. 1, the method begins with the step of converting a noisy speech signal from an analog signal to a digital signal, as indicated at block 10.

Next, the method continues with the step of performing a short-term analysis of the noisy speech signal by extracting short-term parameters having time trajectories, as shown by block 12, to obtain a plurality of frequency components each having a first magnitude spectrum and a phase spectrum, as shown by blocks 14 and 16, respectively. First, each segment of the speech signal is weighted by a Hamming window, W(n). As is known, a Hamming window is a finite duration window and can be represented as follows:

$$W(n)=0.54+0.46\cos[2\pi n/(N-1)],$$

where N, the length of the window, is typically about 20 ms.

Next, the weighted speech segment is transformed into the frequency domain by a Discrete Fourier Transform (DFT). The real, RE[S(ω)], and imaginary, IM[S(ω)], components of the resulting short-term speech spectrum are then squared and added together, thereby resulting in the short-term power spectrum P(ω). The power spectrum P(ω) can be represented as follows:

$$P(\omega)=RE[S(\omega)]^2+IM[S(\omega)]^2.$$

The magnitude spectrum, A(ω), and the phase spectrum, φ(ω), are readily found from the power spectrum. The magnitude spectrum, as indicated by block 14, is defined as:

$$A(\omega)=|S(\omega)|,$$

and the phase spectrum, as indicated by block 16, is defined as:

$$\phi(\omega)=\tan^{-1}\{IM[S(\omega)]/RE[S(\omega)]\}\pm\pi.$$

A Fast Fourier transform (FFT) is preferably utilized, resulting in a transformed speech segment waveform. Typically, for a 8 kHz sampling frequency, a 256-point FFT is needed for transforming 256 speech samples from the 32 ms window.

Next, the method includes the step of performing a non-linear operation on the magnitude spectrum, as shown by block 18. Preferably, the non-linear operation is a n-th root compression, such as a cubic-root compression.

The method further includes the step of filtering the time trajectories of the compressed magnitude spectrum, as shown by block 20, so as to map the noisy speech signal to an estimate of the plurality of magnitudes of the clean speech signal. In the preferred embodiment, a linear filtering of the compressed magnitude spectrum is performed utilizing Finite Impulse Response (FIR) filters. Preferably, the FIR filters are non-causal FIR Wiener-like filters. The Wiener filter refers to the optimal least squares filter for estimating a random sequence from observing a second random sequence. Wiener filters are well known as described in "Random Signals: Detection, Estimation and Data Analysis," by K.S. Shanmugan and A.M. Breipohl, John Wiley & Sons, 1988, pp. 407–448. For a 256 point FFT, 129 unique filters are required, one for each unique frequency bin of the symmetric magnitude spectrum of speech.

Assuming $p_i^n(k)$ to be the cubic-root estimate of the short-term power spectrum of noisy speech in frequency bin i (i=1 to 129 and k corresponds to an 8 ms step), the output of each filter is the following:

$$\hat{p}_i(k)=\sum_{j=-M}^{M} w_i(j)P_i^n(k-j),$$

where $\hat{p}_i(k)$ is the estimate of the clean speech cubic-root spectrum. The FIR filter coefficients $w_i(j)$ are found such that $\hat{p}_i$ is the least squares estimate of the clean signal $p_i$ for each frequency bin i. In the preferred embodiment, M=10 corresponding to 21 tap noncausal filters. Any negative spectral values of $\hat{p}_i(k)$ after filtering are substituted by zeros.

Preferably, the exact filter characteristics are typically derived from training data by a least square Wiener solution and would depend on the exact character of the training data. The training data consists of data recorded in parallel in the clean environment and the noisy environment. However, the filters may be derived without any knowledge of the environment.

A non-linear filtering of the compressed magnitude spectrum may also be performed utilizing artificial neural networks. Preferably, the artificial neural networks are implemented as feed-forward sigmoidal networks. Sigmoidal networks are well known as described in "Neural Networks: A Comprehensive Foundation," by Simon Haykin, MacMillan Publishing Company, 1994.

The compressed magnitude spectrum may also include filtering a plurality of adjacent frequency channels utilizing a multiple-input-single-output filter wherein the additional inputs represent frequency components from typically 2–4 neighboring frequency bins. Multiple input filters are well known as described in "Modern Signals and Systems," by H. Kwakernaak and R. Sivan, Prentice Hall, 1991.

Alternatively, the filtering of the plurality of adjacent frequency channels may be performed utilizing a multiple-input-multiple-output filter wherein the additional outputs represent frequency bins not present in the input signal, such as frequency components above 4 KHz which are not typically present in telecommunications. Typically, 128 neighboring frequency bins are used as the additional inputs resulting in 129×21=2709 inputs to the multiple-input-multiple-output filter. The filter typically has two outputs wherein the second output represents the frequency bins not present in the input signal.

With continuing reference to FIG. 1, the method proceeds with the step of performing an inverse non-linear operation on the filtered compressed magnitude spectrum so as to obtain a modified magnitude spectrum, as indicated at block 22. Preferably, the inverse non-linear operation is an n-th power expansion, such as the cubic-power expansion.

The next step of the method is the step of generating an estimated clean speech signal, as shown by block 24. The speech is reconstructed using a conventional overlap-add technique which is used to reconstruct a time domain signal from its fourier magnitude and phase. The overlap-add technique is described in "Short Term Spectral Analysis, Synthesis, Modification by Discrete Fourier Transform," by J.B. Allen, IEEE Transactions on Acoustics, Speech, and Signal Processing, Vol. ASSP-25, No. 3, 235–238, June 1977.

Typically, the clean speech is estimated based on the modified magnitude spectrum and the original phase spectrum of the plurality of frequency components. However, to avoid distortion in the synthesized signal when the magnitude spectrum has been severely modified, an iterative algorithm is performed on the phase, as shown by blocks 25 and 26.

The iterative algorithm serves to minimize a mean squared error between the desired magnitude spectrum and the spectrum produced by the synthesized signal as described in "Signal Estimation From Modified Short-Time Fourier Transform," by D. Griffin and J. Lim, IEEE Transactions on Acoustics, Speech, and Signal Processing, Vol. ASSP, No. 2, 236–243, April 1984. In noise reduction applications, the phase of the noisy signal is used to perform the initial step in the reconstruction. In the case of reconstructing of frequency components that were not initially present in the input signal, a linear map from the available frequency phase components to the reconstructed frequencies is taken as a first approximation.

Finally, the method concludes with the step of converting the estimated clean speech signal from a digital format to an analog signal, as shown by block 28.

Figure 2:
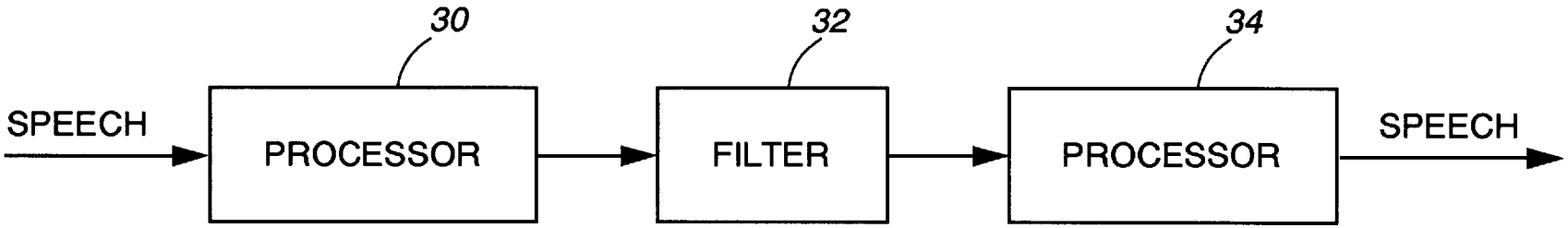
FIG. 2 is a block diagram of the system of the present invention.

Turning now to FIG. 2, there is shown a block diagram of the system of the present invention. The system includes a first processor 30 for extracting time trajectories of short-term parameters from the noisy speed signal to obtain a plurality of frequency components each having a first magnitude spectrum and a phase spectrum. The first processor 30 is also utilized for performing the non-linear operation on the first magnitude spectrum to obtain the second magnitude spectrum. The first processor 30 also includes an A/D converter for converting the speech signal into a digital signal.

The system can also include a filter 32 for filtering the time trajectories of the second magnitude spectrum of the plurality of frequency components. As described earlier, the filter 32 may be any conventional finite impulse response (FIR) filter. Preferably, the FIR filters are non-causal FIR Wiener-like filters.

The system further includes a second processor 34 for receiving the filtered second magnitude spectrum and performing an inverse non-linear operation on the filtered second magnitude spectrum to obtain a third magnitude spectrum. The second processor 34 is also for combining the third magnitude spectrum with the phase spectrum to generate an estimated clean speech signal. The second processor 34 may be of the type of any conventional synthesizer known by one skilled in the art. It should also be appreciated that the first processor 30, the filter 32, and the second processor 34 may be combined in a conventional digital signal processor. The second processor 34 also includes a D/A converter for converting the digital signal into an analog signal.

While the best modes for carrying out the invention have been described in detail, those familiar with the art to which this invention relates will recognize various alternative designs and embodiments for practicing the invention as defined by the following claims.

What is claimed is:

1. A method for generating an estimated clean speech signal from a noisy speech signal, the method comprising:

extracting time trajectories of short-term parameters from the noisy speech signal to obtain a plurality of frequency components each having a first magnitude spectrum and a phase spectrum;

performing a non-linear operation on the time trajectories of the first magnitude spectrum of each of the plurality of frequency components to obtain a corresponding second magnitude spectrum;

filtering the time trajectories of the second magnitude spectrum of each of the plurality of frequency components to obtain a corresponding filtered magnitude spectrum;

performing an inverse non-linear operation on the time trajectories of the filtered magnitude spectrum of each of the plurality of frequency components to obtain a corresponding third magnitude spectrum, the inverse non-linear operation being an exact inverse of the non-linear operation; and combining the third magnitude spectrum with the phase spectrum of each of the plurality of frequency components to generate the estimated clean speech signal.

2. The method as in claim 1 wherein the non-linear operation is an n-th root compression.

3. The method as in claim 2 wherein the inverse non-linear operation is an n-th power expansion corresponding to the nth root compression.

4. The method as in claim 1 wherein the step of filtering includes the step of linear filtering.

5. The method as in claim 4 wherein the step of linear filtering is performed utilizing Finite Impulse Response (FIR) filters.

6. The method as in claim 5 wherein the FIR filters are non-causal.

7. The method as in claim 4 wherein the step of linear filtering includes deriving a Wiener solution.

8. The method of claim 1 wherein the step of filtering includes the step of non-linear filtering.

9. The method of claim 8 wherein the step of non-linear filtering includes utilizing artificial neural networks.

10. The method of claim 9 wherein the artificial neural networks are feed-forward sigmoidal networks.

11. The method of claim 1 wherein the step of filtering includes the step of filtering a plurality of adjacent frequency channels utilizing a multiple-input-single-output filter wherein the multiple inputs represent frequency components from adjacent frequency bins.

12. The method of claim 1 wherein the step of filtering includes the step of filtering a plurality of adjacent frequency channels utilizing a multiple-input-multiple-output filter, wherein additional outputs represent frequency bins not present in the noisy speech signal.

13. The method of claim 1 wherein the step of combining further includes the step of performing an iterative algorithm on the phase spectrum of each of the plurality of frequency components.

14. A system for generating an estimated clean speech signal from a noisy speech signal, the system comprising:

means for extracting time trajectories of short-term parameters from the noisy speech signal to obtain a plurality of frequency components each having a first magnitude spectrum and a phase spectrum;

means for performing a non-linear operation on the time trajectories of the first magnitude spectrum of each of the plurality of frequency components to obtain a corresponding second magnitude spectrum;

a filter for filtering the time trajectories of the second magnitude spectrum of each of the plurality of frequency components to obtain a corresponding filtered magnitude spectrum;

means for performing an inverse non-linear operation on the time trajectories of the filtered magnitude spectrum of each of the plurality of frequency components to obtain a corresponding third magnitude spectrum, the inverse non-linear operation being an exact inverse of the non-linear operation; and means for generating the estimated clean speech signal based on the third magnitude spectrum of each of the plurality of frequency components and the phase spectrum of each of the plurality of frequency components.

15. The system of claim 14 wherein the filter is a linear filter.

16. The system of claim 15 wherein the linear filter is a Finite Impulse Response (FIR) filter.

17. The system of claim 16 wherein the FIR filter is non-causal.

18. The system of claim 15 wherein the linear filter is derived as a Wiener solution.

19. The system of claim 14 wherein the filter is a non-linear filter.

20. The system of claim 19 wherein the non-linear filter is implemented using artificial neural networks.

21. The system of claim 20 wherein the artificial neural networks are implemented as feed-forward sigmoidal networks.

22. The system of claim 14 wherein the filter is a multiple-input-single-output filter.

23. The system of claim 14 wherein the filter is a multiple-input-multiple-output filter.

24. The system of claim 14 wherein the means for generating further comprises means for performing an iterative algorithm on the phase spectrum of each of the plurality of frequency components.

25. The system as recited in claim 14 wherein the non-linear operation is an n-th root compression.

26. The system as recited in claim 25 wherein the inverse non-linear operation is an n-th power expansion corresponding to the n-th root compression.

* * * * *